United States Patent [19]

Sigvardsson

[11] Patent Number: 4,996,973

[45] Date of Patent: Mar. 5, 1991

[54] STOVE AS WELL AS A METHOD AND A DEVICE FOR MANUFACTURING AND MOUNTING FIRE-PLACES

[75] Inventor: Kjell-Evert Sigvardsson, Emmaboda, Sweden

[73] Assignee: Cronspisen Kakelugnsmakeri AB, Sweden

[21] Appl. No.: 438,432

[22] PCT Filed: Jun. 8, 1988

[86] PCT No.: PCT/SE88/00309

§ 371 Date: Dec. 1, 1989

§ 102(e) Date: Dec. 1, 1989

[87] PCT Pub. No.: WO88/10401

PCT Pub. Date: Dec. 29, 1988

[30] Foreign Application Priority Data

Jun. 22, 1987 [SE] Sweden ..... 8702579

[51] Int. Cl.[5] ..... F24B 1/18

[52] U.S. Cl. ..... 126/500; 110/336; 126/513

[58] Field of Search ..... 126/513, 514, 500; 110/336

[56] References Cited

U.S. PATENT DOCUMENTS

| | | | |
|---|---|---|---|
| 3,721,225 | 3/1973 | Tidwell | 126/500 |
| 4,164,931 | 8/1979 | Jenkins | 126/513 |
| 4,562,826 | 1/1986 | Litta | 126/513 |

FOREIGN PATENT DOCUMENTS

| | | | |
|---|---|---|---|
| 2381974 | 9/1978 | France | 126/500 |
| 585253 | 2/1947 | United Kingdom | 126/513 |

*Primary Examiner*—Carroll B. Dority

*Attorney, Agent, or Firm*—Townsend and Townsend

[57] ABSTRACT

In a method for manufacture and mounting of fire-places, e.g. stoves, a lower and an upper half of the fire-place are manufactured separately and transported to the mounting place. The lower half is positioned and subsequently the upper half is lifted by means of a wheel-supported lifting frame, adjusted into its correct position and fastened by means of mortar to said lower half, whereupon connection to a smoke flue and a chimney is made. A device for mounting fire-places, e.g. stoves, comprises a wheel-supported lifting frame having a unit for lifting prefabricated fire-place halves to which lifting means are attached. The frame has such dimensions that lifting a distance corresponding at least to the height of said lower fire-place half is possible.

11 Claims, 4 Drawing Sheets

A-A

B-B

STOVE AS WELL AS A METHOD AND A DEVICE FOR MANUFACTURING AND MOUNTING FIRE-PLACES

The present invention relates to a method for manufacturing and mounting fire-places, e.g. stoves, a device for mounting such fire-places as well as a stove.

Fire-places, e.g. masonry stoves, have been used for a long time.

Stoves are thus known since the eighteenth century and are very efficient sources of heat.

Since a stove is built in a comparatively complicated manner, it is very laborious to build up a stove of bricks or another suitable stone material in the conventional way, an advanced craftmanship being also needed in order to achieve a satisfactory result. Consequently, stoves are nowadays expensive.

This has resulted in efforts to build stoves in a more simple way and manufacture them from prefabricated larger blocks. Such a stove construction is described in Swedish patent No. 8102543-9.

The object of the present invention is to further simplify the manufacture and mounting of masonry fire-places in general, particularly stoves, in order to be able to install it without the expert knowledge of a stove constructor.

Thus, according to the invention a fire-place is manufactured in two halves in a factory, preferably from blocks according to e.g. the Swedish patent cited above, and subsequently the fire-place halves are transported to the place where they are to be mounted and installed. Since each fire-place half e.g. in the case of stove-halves typically weighs 800–1000 kg, one has so far considered it as impossible to carry such heavy units into a residence and to mount one of the units on top of the other. The present invention suggests a surprisingly simple solution to this problem, which so far has been considered insoluble.

By the present invention a plurality of very important advantages are achieved in this way. Thus, the manufacture of the fire-place can be done under better control, the manufacture as well as the installation will be simpler and less expensive, and a stove constructor's expert knowledge is not required, which is a very important advantage since the shortage of stove constructors is flagrant.

The invention accordingly involves a complete novel concept in the present technical field.

The device according to the present invention thus comprises a lifting frame on wheels, by means of which frame the upper fire-place half is lifted and adjusted on top of the lower fire-place half when mounting the fire-place. This operation has, as mentioned, so far not been considered feasible to accomplish in residences, since when transporting such heavy plants trucks of various types have been used, which can not perform such a lifting indoors. Also, the device according to the invention can, during the transport, be used for lifting the fire-place halves from one level to another, e.g. from the ground up on a bridge a few fast steps above the ground.

In accordance with another advantageous embodiment of the invention each fire-place half is provided with lifting means including a metal frame, which is attached around the outer edges of the fireplace half and in which the lifting frame is intended to engage. This metal frame can include iron profiles at the top face and the bottom face of the fire-place half along the outer edges as well as bars extending from the top face to the bottom face of the fire-place half at the corners of the fire-place half, which bars are threaded in order to attach the profiles of the top face and the bottom face to each other by means of screwing. In this way the strength of the fire-place half is improved too, which may be of importance for reducing the risk of damages during the transport.

In embodiments, in which the outer surfaces of the fireplace are intended to be directly painted, said bars extend in holes through the corner regions of the fire-place halves inside the outer surfaces. Said holes are preferably somewhat larger than the diameter of the bars such that the bars can move through the holes e.g. during temperature fluctuations without producing stresses.

According to another aspect of the invention an insert to produce hot water, is placed inside a stove, in its central flue at its rear wall, above its fire-place. Said insert presents an inlet and an outlet, which are designed to let water in and out respectively and connected to pipe lines, which extend through the wall of the stove. In this way it is possible to connect said insert to the hot-water system of the house in order to heat the house itself as well as e.g. its tap water. In this way the stove will function as a central heater and the overall efficiency of the combustion in the stove will be even better.

The invention will now be explained in more detail by means of the following description of selected exemplifying embodiments with reference to the attached drawings, on which:

Figure 1:
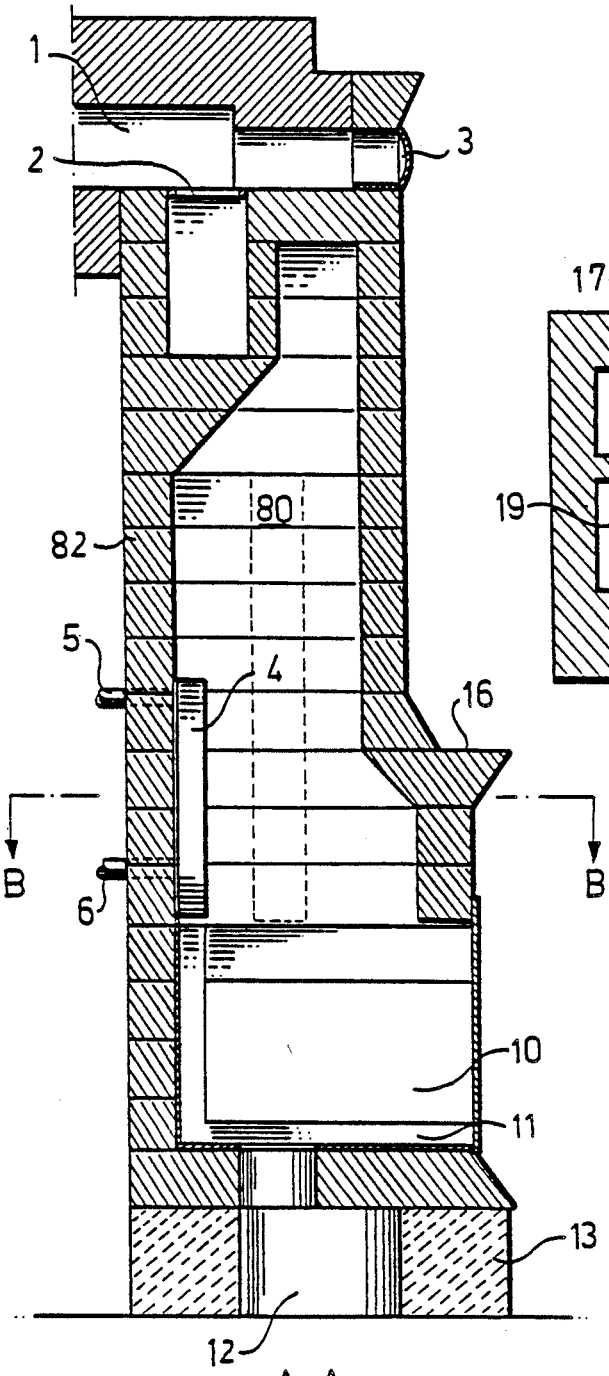
FIG. 1 shows a stove according to the invention, in a longitudinal section.

FIG. 1 shows in a longitudinal section a stove having a fire-place 10 and a hot air cassette 11 with a suction fan 12 connected to said cassette in the stove base 13. The upper portion of the stove is connected to a smoke flue 1. This portion of the tiled stove also includes a damper 2 and a soot door 3.

Figure 2:
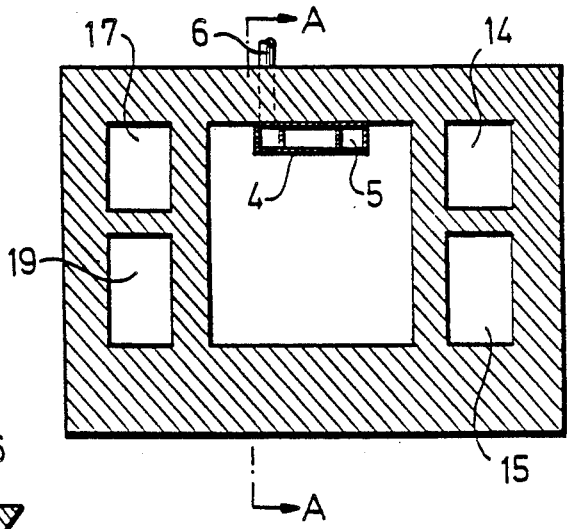
FIG. 2 shows a section along the plane B—B in FIG. 1.

FIG. 2 shows in cross-section the various flues 14,15,17 and 19 in the stove for directing the fluegas in upward and downward directions respectively in the stove.

According to the invention the stove is manufactured by prefabricating the lower and the upper stove-halves, preferably built by blocks, as has been mentioned above, the lower stove-half preferably extends to and includes the course which forms the shelf 16, see FIG. 1. The upper stove-half preferably extends to the course for connection to the smoke flue 1.

Figure 3:
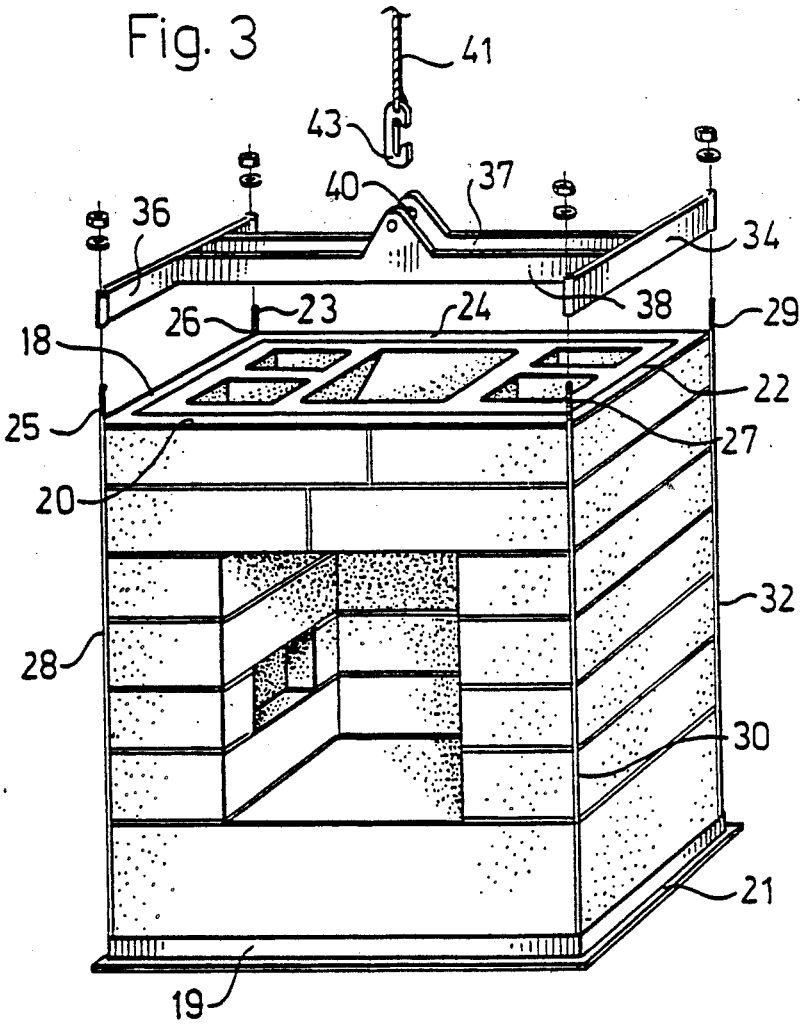
FIG. 3 shows an embodiment of a lower stove-half, which is provided with lifting means according to the invention as well as the lifting member used in the invention.

FIG. 3 shows an embodiment of the lower stove-half, which thus is made of blocks. This stove-half is provided with lifting means in the form of a metal frame, which is attached around to the outer edges of the stove-half and in which a lifting member is adapted to engage to lift the stove-half to its position in connection with its mounting and installation. This metal frame, which is applied in connection with the manufacture of the stove-half, comprises iron profiles 18,19,20,21,22 and 24, which are arranged in a square at the upper and the lower faces of the stove-half along the outer edges. At the corners of the stove-half vertical bars 26,28,30 and 32 extend between the profiles at the upper and lower faces. Said bars are threaded at their ends 23,25,27 and 29 for connecting the profiles at the two faces of the stove-half by screwing. In this embodiment the profiles at the lower face are formed of T-iron. Alternatively the profiles at the lower face can be replaced by a continuous bottom plate, preferably of metal.

In embodiments intended to be directly painted on the outer side said bars extend through holes made in the corner regions of the blocks, inside the outer faces of the blocks. Said holes are then somewhat larger than the diameter of the bars, such that the bars are movable in the holes without producing stresses.

The metal frame shown in FIG. 3 also improves the strength of the stove, the risk of damages in connection with the transport in this way being decreased.

When the stove-half is to be lifted, the yoke shown in FIG. 3 is secured by screwing to the upper face of the stove-half. The lifting yoke is substantially H-shaped and it is secured by screwing with stems 34,36 of the H-shape extending along two opposite edges of the stove-half, i.e. stem 36 is secured above profile 18 and stem 34 above profile 22. Between the stems 34 and 36 a transversal web extends in the form of two parallel separated girders 37,38 provided with a transversal pin 40 in the middle of said web, for hooking a lifting cable 41.

Figure 5:
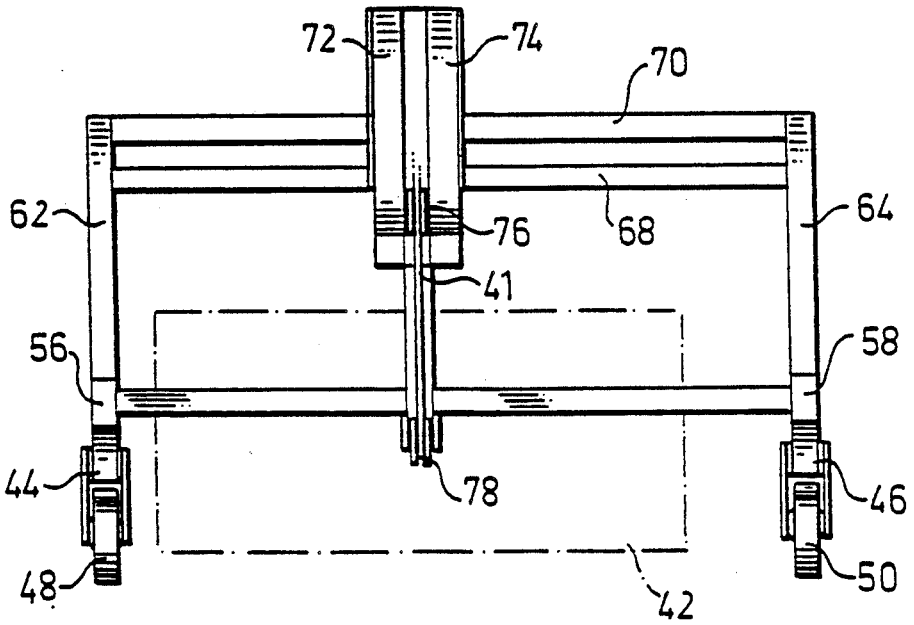
FIG. 5 is a top view of the device in FIG. 4.
Figure 4:
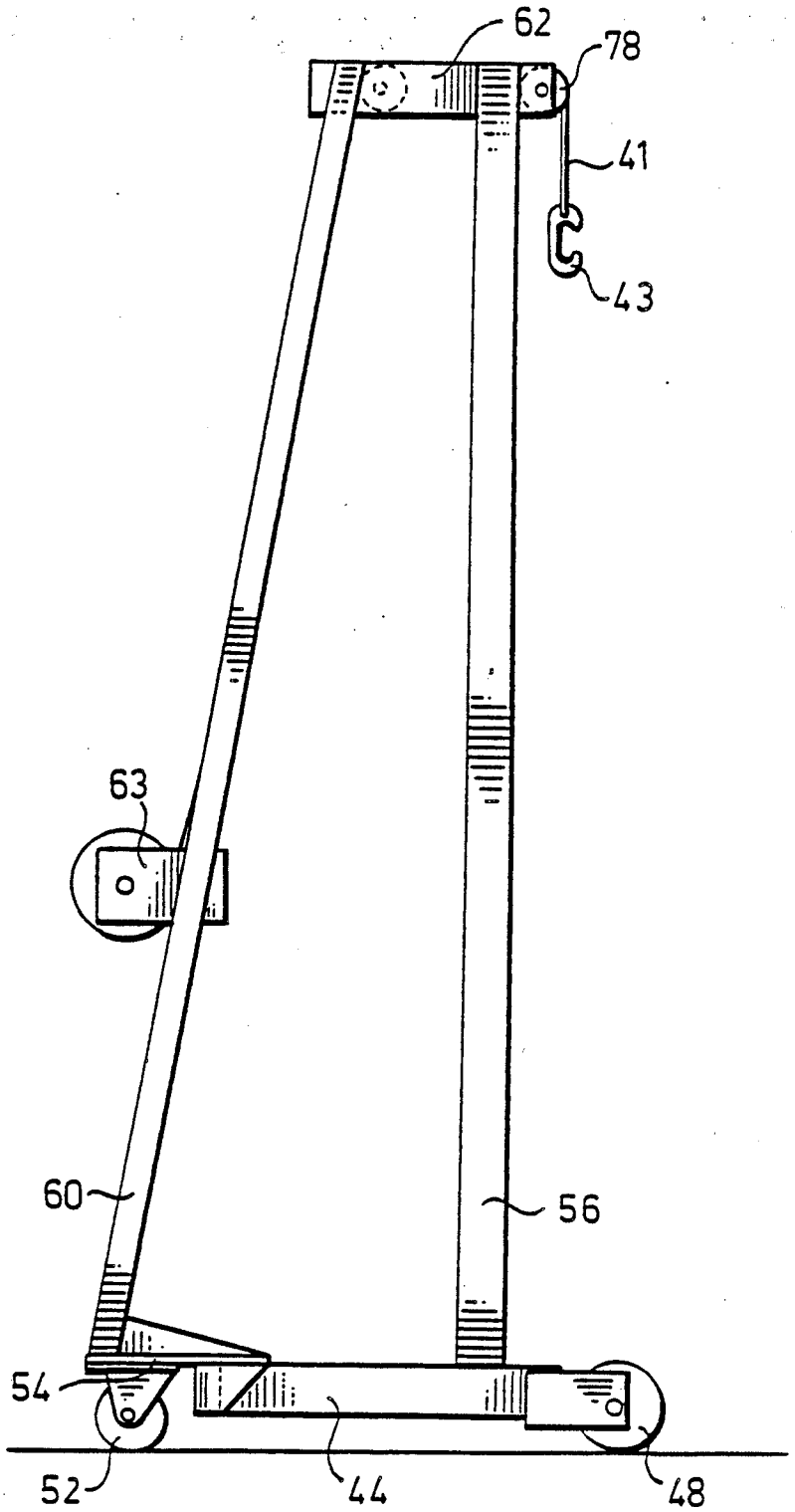
FIG. 4 is a lateral view of an embodiment of the device according to the invention.
Figure 6:
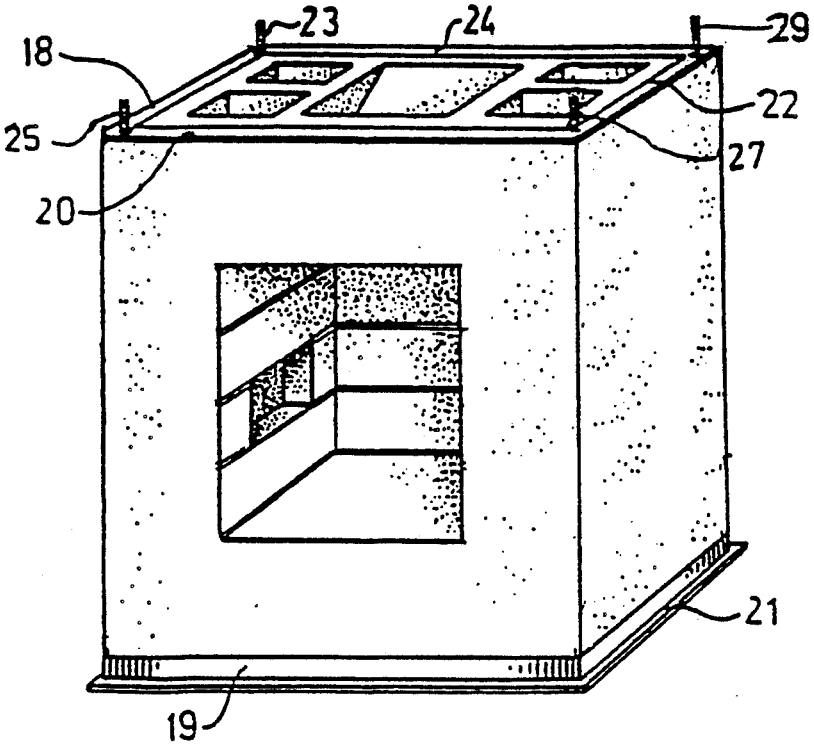

In order to lift the stove-halves in connection with their mounting and installation the device shown in FIG. 4 and 5 is used. It mainly comprises a substantially U-shaped base having such dimensions that a stove-half, which is schematically indicated by 42 in FIG. 5, can be placed inside the U-shape with legs 44,46 of the U-shape disposed on each side of the stove-half. The base is supported by two freely rotatable castor wheels 48,50 at the free ends of the legs 44,46 of the U-shape as well as a third freely rotatable castor wheel 52 at the center of web 54 of the U-shaped base, which web connects said legs.

On the legs 44,46 of the base a vertical lifting portal is disposed, which comprises two posts 56,58, which are connected by a transversal girder 66 at the upper end.

From the web 54 of the U-shape a frame means 60 extends upwardly to the upper portion of the lifting frame, where it by means of lateral pieces 62,64 is connected to the posts 56,58 of the lifting portal. The lateral pieces 62,64 are mutually connected by transversal girders 66,68 and 70. The frame means 60 comprises two parallel girders 72,74.

On the frame means 60 a manual hoist is disposed, schematically shown at 63 in FIG. 4 from which a cable runs via rollers 76 and 78 disposed at the upper portion of the lifting frame. From the roller 78 the cable end 41, which is provided with a suitable lifting hook 43, runs downwardly to be hooked on the lifting pin 40 of the lifting yoke, mounted on the stove-half to be lifted (see FIG. 3) and by means of which the stove-half can be lifted by the manual hoist, provided with a lock.

The lifting frame preferably can be adjusted in a vertical direction, the frame means and the posts of the hoisting portal being telescopically displaceable inside each other with possibility to be locked in various positions. In this way an adjustment to different ceiling heights and different stove-sizes is possible in a convenient manner. The lifting frame preferably also is foldable to facilitate the transport from one mounting place to another and to facilitate the displacement of the frame through the door of an apartment room. The transport of the stove-halves in this connection preferably is accomplished by means of a small truck.

The manufacture and the installation of a stove according to the present invention are carried out in the following manner.

The stove is prefabricated in two halves in a factory, the prefabrication possibly being complete, i.e. the stove-halves are provided with tiles or other coating or painting. Subsequently the stove-halves are transported to the place where the stove is to be mounted and installed. The lifting yoke is mounted on the lower stove-half and by means of the device according to the invention the lower stove-half is lifted and fitted into its correct position by displacing the wheel-supported lifting frame to the desired position. As the wheels can be freely turned, the lifting frame can be displaced in any desired direction and thus the stove-half can be adjusted to any desired position. The wheels can preferably be locked against rotation as well as turning during the lifting operation itself.

When the lower stove-half has been positioned to its correct position, the lifting yoke is unscrewed and the upper stove-half is provided with the lifting yoke, whereupon this stove-half is lifted by means of the device according to the invention with said device positioned beside the lower stove-half such that the upper stove-half will be at a distance above the lower stove-half. Subsequently the device carrying the upper stove-half, is rolled to such a position, that said upper stove-half is in the correct position above the lower stove-half. A suitable mortar is applied to the surfaces of the lower and the upper stove-halves, which face each other, and thereafter the upper stove-half is lowered to its definitive position on the lower stove-half. Subsequently the lifting yoke is removed from the upper stove-half, the device is removed and the stove is connected to the smoke flue.

Because of the heavy load, which shall be lifted with the device according to the invention, the lifting device preferably is placed on e.g. a rigid plate, if the installation takes place in a room having easily damaged floors, to distribute the pressure of the wheels of the device in this way and consequently avoid damages to the floor.

Although the invention in the preceding has been described in connection with the application to a stove, it is applicable to (masonry) fire-places in general. Besides, the device according to the invention can also be used for transport and installation of other heavy items in e.g. rooms.

In order to increase the efficiency of stoves an insert 4 for heating water can be disposed inside the stove in its central flue 80 at its rear wall 82 above fire-place 10, as is shown in FIGS. 1 and 2. This insert preferably comprises a substantially rectangular case having an inlet 5 and an outlet 6 for water fed into it and water leaving it respectively. By means of the inlet and outlet 5,6 said insert 4 is connected to the hot water system of a house and by means of the circulation pump of the system the water will be circulated through said insert. Heat produced when combustion takes place in the stove will then be utilized also for hot water heating, e.g. for heating and tapping purposes.

As shown particularly in FIG. 2, the insert is mounted at a certain distance from the rear stove wall 82.

What is claimed:

1. A masonry fire-place, e.g. a stove, comprising at least two prefabricated halves, wherein each fire-place half has a metal frame around its outer edges, said metal frame comprising bars extending between upper and lower faces of each fire-place half, which bars are provided with threaded upper ends projecting above an upper side of each fire-place half to enable mounting of a lifting yoke for lifting each fire-place half for transport and installation.

2. The fire-place according to claim 1, wherein said metal frame includes iron profiles, which are arranged in a rectangle at the upper and the lower faces of each fire-place half along its outer edges as well as at its corners, said bars being threaded to connect said profiles of said upper and said lower faces to each other by means of screwing.

3. The fire-place according to claim 1, wherein said metal frame includes a bottom plate, on which said fire-place half is supported and from which the threaded bars extend at the corners of said fire-place half to iron profiles, disposed at the upper face of said fire-place half along its outer edges to connect these to said bottom plate by means of screwing.

4. A method for mounting a masonry fire-place according to claim 1, said fire-place halves being transported to a place to be installed, wherein a lifting yoke is mounted to the metal frame at the upper face of a lower fire-place half, whereupon the lower fire-place half is lifted by a lifting frame, engaging the lifting yoke, and is positioned into its proper position and lowered to rest on its foundation, said lifting yoke subsequently being moved from the lower fire-place half to the metal frame at the upper face of an upper fire-place half, which is lifted by the lifting frame to a level a certain distance above the lower fire-place half and is displaced into a position above the lower fire-place half whereupon mortar is applied on opposing surfaces of the lower and upper fire-place halves and the upper fire-place half is lowered onto the lower fire-place half, and the lifting yoke is demounted and the fire-place connected to a smoke flue.

5. The method according to claim 4, wherein said fire-place halves are adjusted into position by displacing the lifting frame.

6. A lifting yoke for mounting a masonry fire-place, e.g. a stove, said fire-place being prefabricated in at least two halves with a metal frame around its outer edges, which fire-place halves are transported to a place to be installed wherein said lifting yoke is mainly H-shaped, said yoke being attached to said metal frame with stems of said H-shaped extending along two opposite edges of said fire-place half, and in that a transversal web, which connects said stems, is provided with means in which a lifting force is intended to be applied.

7. The lifting yoke according to claim 6, wherein said stems are secured by screws on upper end of bars extending between upper and lower faces of each fire-place half.

8. The fire-place of claim 1 wherein a lifting yoke is attached to an upper face of said metal frame, in which a yoke lifting cable is hooked.

9. A masonry fire-place, e.g. a stove, comprising at least two prefabricated halves and being painted on an outer side, wherein each fire-place half has a metal frame around outer edges of upper and lower faces and bars extending between the upper and lower faces of each fire-place half through holes, which are made in corner regions of each fire-place half inside its outer faces, which bars are provided with threaded upper ends projecting above the upper face of each fire-place half to enable mounting of a lifting yoke for lifting each fire-place half for transport and installation.

10. The fire-place according to claim 9, wherein said metal frame includes iron profiles, which are arranged in a rectangle at the upper and the lower faces of each fire-place half along its outer edges, said bars being threaded to connect said profiles of said upper and said lower faces to each other by means of screwing.

11. The fire-place according to claim 9, wherein said metal frame includes a bottom plate, on which said fire-place half is supported and from which said bars extend to iron profiles, disposed at the upper face of each fire-place half along the outer edges to connect the outer edges to said bottom plate by means of screwing.

* * * * *